United States Patent [19]

Hellwig

[11] Patent Number: 5,022,316

[45] Date of Patent: Jun. 11, 1991

[54] NEWSPAPER BUNDLER WITH RECYCLABLE STRAPS

[76] Inventor: John Hellwig, 2838 Woolsey St., Berkeley, Calif. 94705

[21] Appl. No.: 398,387

[22] Filed: Aug. 24, 1989

[51] Int. Cl.[5] ..... B65B 13/18

[52] U.S. Cl. ..... 100/34; 53/586; 53/590; 53/592; 100/1; 100/8; 206/83.5; 211/50; 156/443

[58] Field of Search ..... 100/1, 8, 11, 34; 156/443, 468, 212; 53/590, 592, 586, 390, 391, 392, 399; 211/50; 206/83.5

[56] References Cited

U.S. PATENT DOCUMENTS

| | | | |
|---|---|---|---|
| 2,744,461 | 5/1956 | Genco . | |
| 2,781,621 | 2/1957 | Wilson | 53/592 |
| 2,966,769 | 1/1961 | Iob | 53/592 X |
| 3,330,409 | 7/1967 | Jorgensen | 100/1 X |
| 3,739,714 | 6/1973 | Howard . | |
| 3,850,092 | 11/1974 | Montgomery . | |
| 4,193,340 | 3/1980 | Finn . | |
| 4,681,032 | 7/1987 | McDermott . | |
| 4,698,248 | 10/1987 | Gallagher et al. | 100/34 X |

*Primary Examiner*—Philip R. Coe
*Assistant Examiner*—Stephen F. Gerrity
*Attorney, Agent, or Firm*—David Pressman

[57] ABSTRACT

A newspaper bundler comprises a rigid frame assembly (FIGS. 1 and 2) for enabling newspapers to be easily stacked into a pile (12). The frame includes a U-shaped crosswise holder (14) whose upstanding opposing side arms are made of sheet metal or plastic channels (22). A stack of paper bundling straps (26) is positioned on the crosswise portion. The channels each have a pocket for holding fan-folded end portions (30) of the stack of paper straps. One end portion of each strap is coated with adhesive (32) so when the end portions of a strap are pulled from their pockets, they can be attached together around the pile of papers to securely bundle them so that they can be carried easily with one hand (FIG. 5). The entire bundle is recyclable at a paper mill. In lieu of sheet metal side channels with pockets, the side pockets can be formed of tubular members (FIG. 6) bent and shaped to form pockets for the fan-folded ends of the straps. Also, the entire frame assembly can be a single, integral injection-molded piece of plastic.

20 Claims, 2 Drawing Sheets

NEWSPAPER BUNDLER WITH RECYCLABLE STRAPS

BACKGROUND—FIELD OF INVENTION

This invention relates generally to the recycling of used products, specifically to a device for enabling newspapers to be bundled for disposal quickly and economically, with the bundling straps being themselves recyclable.

BACKGROUND—DESCRIPTION OF PRIOR ART

Most purchasers of newspapers, when finished reading them, want to dispose of the papers in an easy, economical, and quick manner. The easiest and quickest way to handle and dispose of used newspapers is simply to throw them into the trash. However this is ecologically unsound since the papers aren't recycled if they are commingled with other trash. Also the papers quickly take up much of the available space in the trash bag or trash container.

Currently, to recycle newspapers, one must bundle and carry them to a recycling center, or, in a few communities, to a curbside for collection by a recycler.

Users can bundle used newspapers manually, e.g., by taking a bundle of the desired size, wrapping string around the bundle, and tying the string. However most users find this operation awkward and time consuming since they have to lift the bundle and manually position and wrap string around it several times, knot it, etc. I.e., the process is slow and cumbersome due to its manual nature. As a result many users do not take the trouble to bundle their papers and therefore carry them out in loose, unbundled stacks which are difficult to handle. Also this produces litter since individual papers often separate and sometimes blow away. Further it is ecologically harmful since users often do not want to take the trouble to recycle their papers as they are difficult to handle.

Furthermore the traditional means for bundling papers (string, tape, shopping bags, wire, etc.) are incompatable with the pulping process used for recycling newspapers at paper mills; thus such bundling means, from the point of view of the recycler, are contaminants which require labor and time to remove, thus reducing the value of the collected papers.

In the past inventors have provided or suggested several types of devices for facilitating the bundling process.

E.g., Genco, in U.S. Pat. No. 2,744,461 (1956), shows a newspaper bundler employing a collapsible newspaper container with spools of r tying cord attached to two sides of the container. Howard (U.S. Pat. No. 3,739,714—1973) shows a newspaper bundler stacker comprising a wire frame with a bottom holder for a spool of tying cord. Montgomery (U.S. Pat. No. 3,850,092—1974) shows a newspaper bundler employing a stacking frame which is assemblable and which has a holder for a spool of tying cord. Finn (U.S. Pat. No. 4,193,300—1980) shows a newspaper bundler comprising a base with a newspaper receptacle with uprights for holding tying cord. However all of these devices provide only a slight improvement in the tying process since their users still have to wrap the cord around the bundle and tie it manually. Also they have to periodically install and replace the cord spools, an awkward and time-consuming operation. Further the cord itself is not recyclable with the newspapers and therefore is considered a contaminant which devalues the collected newspapers. McDermott, in U.S. Pat. No. 4,681,032 (1987), shows a newspaper bundler employing a container, the bottom of which has a stack of crossed ties made of plastic strips with button-type locking means on their ends. The ties are held together (FIG. 7) by peelable holding strips. A device (FIG. 3) holds the strips in a crossed relationship. However this device is complex and hence expensive to manufacture. Also it is awkward to use since users will find it difficult to load and tie or attach the crossed strips together. Further the plastic strips are not easily recyclable with the newspapers since they are not water soluble and cannot be pulped; also if burned they produce noxious vapors and they will not self-decompose readily.

Other devices and methods have also been proposed, but they still suffer from the same disadvantages as the above prior-art devices. In fact none of the proponents of the prior-art devices or methods have even recognized, much less solved, the problem of providing a bundling means which is compatable with the pulping process. In addition, prior-art methods and devices had other disadvantages which made them less than satisfactory to most regular users.

OBJECTS AND ADVANTAGES

Accordingly, several objects and advantages of the invention are to provide a newspaper bundler which is easy, quick, and simple to use and load, which is economical, simple, and compact in construction, which does not require the manipulation, knotting, or tying of string or ties, the installation of spools of string, or any awkward, or complicated steps, which provides bundles with total recyclability without the need to remove the means for bundling, which is so simple and convenient to use that it encourages users to recycle their papers, and which in turn improves the environment by (a) eliminating loose papers from blowing about, (b) by reducing the waste stream to landfills, and (c) by reducing the need for new newspaper wood pulp, thereby reducing deforestation.

Further objects and advantages will become apparent from a consideration of the ensuing description and the accompanying drawings.

DRAWING FIGURES

Figure 1:
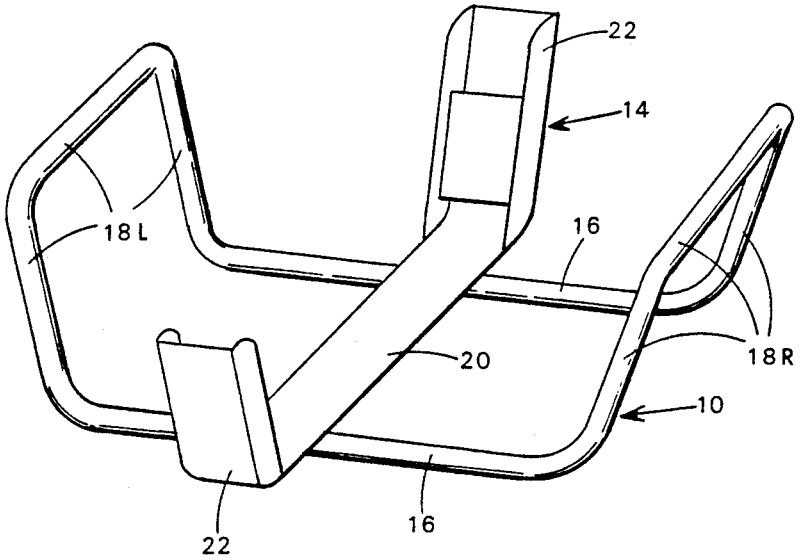
FIG. 1 is a perspective view of a newspaper bundler with a sheet metal cross member according to a preferred embodiment of the invention.

| Drawing Reference Numerals: | |
|---|---|
| 10 tubular frame | 12 pile of newspapers |
| 14 sheet metal holder | 16 bottom section of 10 |
| 18 (L & R) end section of 10 | 20 bed portion of 14 |

-continued

| Drawing Reference Numerals: | |
|---|---|
| 22 side channels of 14 | 24 partition |
| 26 paper bundling strap | 28 center section of 26 |
| 30 end section of 26 | 32 adhesive coating |
| 34 release paper | 36 overlapping ends |
| 38 tubular holder | 40 parallel bottom tubes |
| 42 upright section | 44 crosspiece |
| 46 upper section | 48 bight section |
| 50 bottom loop | |

SUMMARY

In accordance with a preferred embodiment of the invention, a newspaper bundler comprises a rigid frame assembly or cradle for holding the newspapers and enabling them to be easily stacked into a bundle. The frame includes a U-shaped crosswise holder whose upstanding opposing side arms are channel shaped. A stack of paperboard bundling straps are positioned on the crosswise portion. The side arm channels each have a pocket for holding fan-folded portions of the ends of the stack of paper straps. The straps are made of materials, including adhesive coatings on their ends, which can be recycled along with the newspapers.

DETAILED DESCRIPTION OF FRAME—FIGS 1 AND 2

FIG. 1 shows a frame assembly for the newspaper bundler according to a preferred embodiment of the invention. It comprises a relatively long U-shaped tubular frame 10 which encompasses the longer dimension of a pile of folded papers 12 (FIG. 4) and an attached, U-shaped relatively short, orthogonally mounted sheet metal bundling strap holder 14 (FIG. 1). Frame 10 and holder 14 cooperate to form a cradle for holding and guiding a stack or pile of newspapers 12.

Frame 10 comprises an endless tubular member which is bent into the shape shown. I.e., it has a bottom or center portion formed of two parallel, spaced, straight tubular members or sections 16 and two upstanding, opposing side or end portions 18L and 18R. End portions 18L and 18R are each formed of two spaced vertical segments which extend from the ends of bottom portions 16L and 16R, as indicated, and a top interconnecting or bight segment. End portions 18 flare outwardly sightly as indicated, so that each makes an angle of about 100° with bottom sections 16. Frame 10 may be formed of steel or aluminum tubing which has an outer diameter of about 2 cm and which has been bent and welded in the shape indicated. Preferably bottom sections 16 are about 37 cm long and end sections 18 are about 14 cm high.

Holder 14 has a flat center bed portion 20 and upstanding, channel-shaped, opposing side channels 22. Bed portion 20 is welded or bolted (welds or bolts not shown) to the tops of members 16. Side channels 22 each comprise an inwardly facing vertical channel which extends up from the ends of bed portion 20 at an angle of about 100°. Each channel includes a flat partition 24 bridging the sides of the channel and parallel to and spaced from the center or back wall of the channel by about 3 cm. The bottom edge of each partition is spaced from bed 20 by about 3 cm and is about 5 cm high. Each partition thus forms, in cooperation with its channel, an open-bottomed pocket. Preferably holder 14 is formed of steel about 1 mm thick and channels 22 are about 4 cm deep and about 14 cm high.

Alternatively, frame 10, together with holder 14, can also be fabricated as one integral, injection-molded plastic part.

DETAILED DESCRIPTION OF STRAPS—FIG 3

Figure 4:
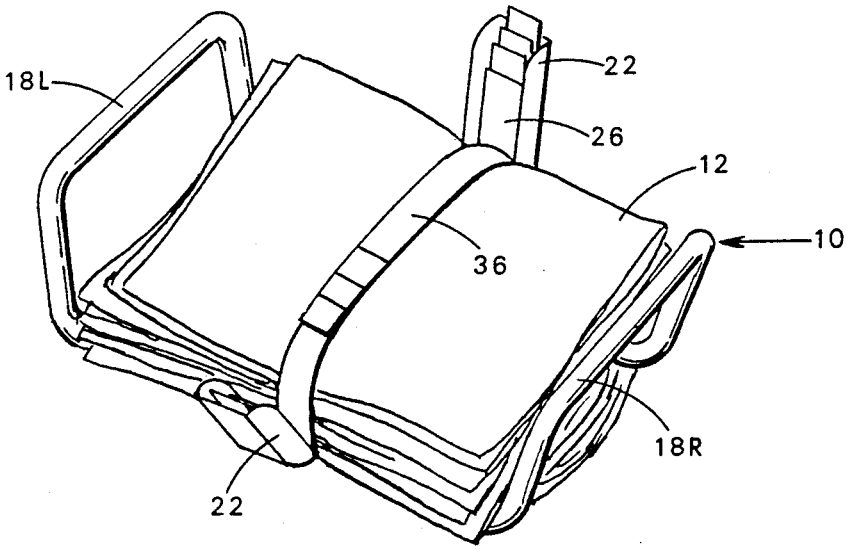
FIG. 4 is a perspective view of the bundler of FIG. 1 with a stack of newspapers bundled therein.

Paper bundling straps 26, shown in FIG. 4, are positioned on holder 14, i.e., on bed portion 20 and in channels 22. Each strap is an elongated strip of strong paperboard, such as a mixture of recycled kraft and newspaper and is about 1 mm thick, 4 cm wide, and 104 cm long. Each strap has two symmetrical sets of five or more crosswise or transverse folds A to E on the respective sides of a center section 28 which is about 30 cm long. The separations between adjacent folds are as follows: A to B: 10 cm, B to C: 2 cm, C to D: 2 cm, and D to E: 6 cm. Straps 26 thus have end sections 30 which are each 17 cm long. Fold A is an inward fold as indicated, folds B to D are outward folds, and fold E is another inward fold. The end portion of one end section 30 on each strap is coated with a layer 32 of adhesive about 14 cm long. Preferably a pressure-sensitive, repulpable, water-soluble adhesive is used, such as that sold under the trademark NICOMELT by IGI Adhesive, Lyndhurst, N.J. (described in U.S. Pat. No. 4,331,576 (1982) to Maletsky et al. In practice about ten straps are stacked in holder 14 and are sold in stacks of such size as a consumable supply item for the bundler.

The adhesive layer of each strap is protected in either of two ways: (1) As indicated in the left side of FIG. 3, the end section 30' of a next higher strap can overlie and be adhered to adhesive layer 32 of the strap below. In this case the undersurface of such end section 30' on each strap has a release coating (not shown) so that it can be peeled from the adhesive layer of the strap below without damaging its adhesive coating. Also the adhesive layer of the top strap in the stack (not shown) is covered by a strip of release paper (not shown). (2) Alternatively, as indicated in the right side of FIG. 3, adhesive layer 32 is covered by a section of release paper 34 which can be peeled away to expose adhesive 32 without damaging or destroying the adhesive. The release paper is of the repulpable type so that it can be bundled and recycled with the bundled newspapers.

OPERATION

Figure 2:
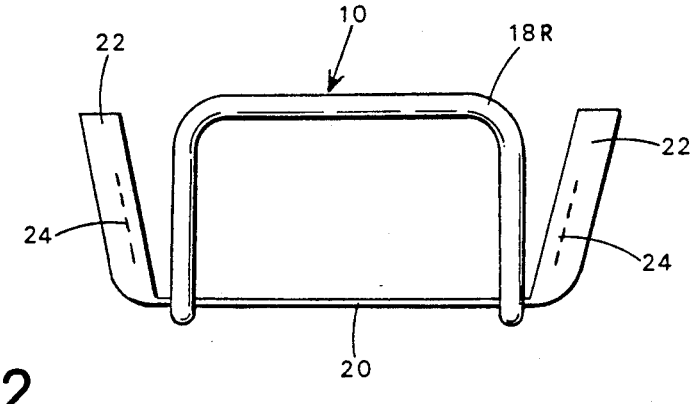
FIG. 2 is a side elevational view of the bundler of FIG. 1.
Figure 3:
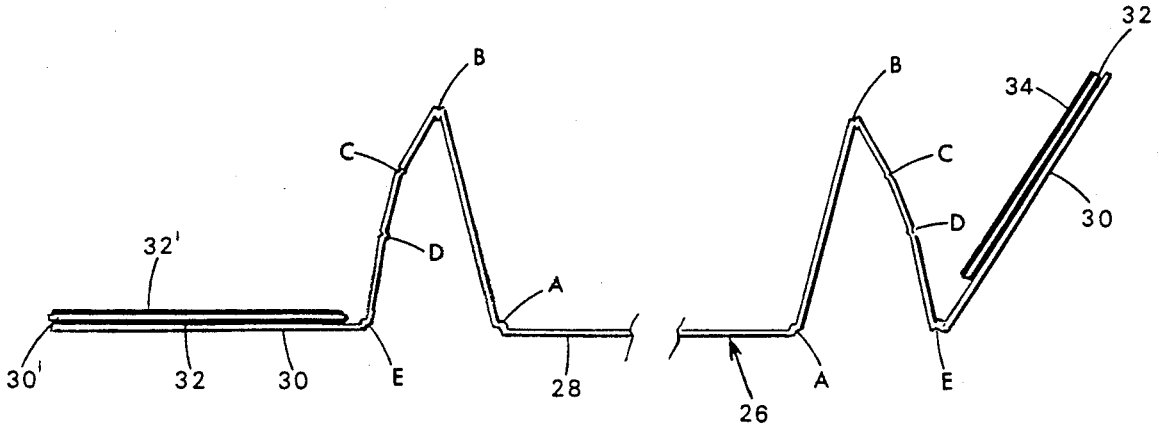
FIG. 3 is a side view of a bundling strip used in the device of FIG. 1, together with alternative forms of adhesive protection.

To ready the bundler for use, the frame assembly of FIGS. 1 and 2 is placed on the floor or any other suitable surface as indicated and a stack of paper straps of the type shown in FIG. 3 (either type of adhesive protection may be incorporated) are loaded into holder 14. The stack of straps is loaded by inserting the leading edge formed by its two folds E (FIG. 3) into the respective pockets in channels 22 (FIGS. 1 and 2), behind partitions 24. This will cause fold E and its adjacent sections (E to B and E to the end of the strap) to fit behind partition 24. Also parts A to B of the straps will fit in front of partition 24 and center section 28 will overlie on bed portion 20 of holder 14. The user pushes the stack of straps down at both sides until their center sections 28 rest on bed 20 and until folds B are resting on the top edges of partitions 24. The bundler is now loaded with straps and is ready for use.

To use the bundler, the user folds newspapers to be discarded so that the papers are folded as sold, i.e., into quarters about 28 cm×35.5 cm (11"×14"). Then the folded papers are piled into the bundler, as indicated in FIG. 4. This may take from two or three days to a week or more, depending on the rate at which the user consumes newspapers. The frame assembly guides and aligns the newspapers to form a neat pile as they are stacked individually into the cradle formed by the frame assembly. When the pile becomes sufficiently high, about 10 cm to 18 cm, the user bundles it as follows:

First the user pulls out vertically, from channels 22, both ends of the top bundling strap of the bundle. As the ends are pulled out, each of the sections between folds B to E "rolls" out of the pocket of holder 14; in this movement the strap folds at C and D. If the adhesive coatings on the straps are protected by their respective overlying straps (32' in FIG. 3), the adhesive end of the top strap will have to be peeled away from the corresponding end of the second strap. This can easily be done by pulling the strap inward toward the center of the frame and then up. If the adhesive coatings are protected by respective release papers 34, the straps will not be attached and the adhesive end can simply be pulled straight up, out of the pocket. In either case, the adhesive on the top strap in the stack will always be protected by release paper; the user peels the release paper off after pulling the end of the top strap out of the pocket. The user places the peeled release paper liner (which is recyclable itself) between the pages of a newspaper so that it becomes part of the recyclable bundle.

Once the ends of the top strap are pulled out of their pockets, the user lays the non-adhesive end of the strap over the stack of papers, pulls it toward the opposite side so as to make it tight, and holds it in place. The user then pulls and lays the other, freed and adhesive end of the strap over the pile and over the non-adhesive end so that the ends overlap and the adhesive end sticks to the non-adhesive end, as indicated at 36.

Figure 5:
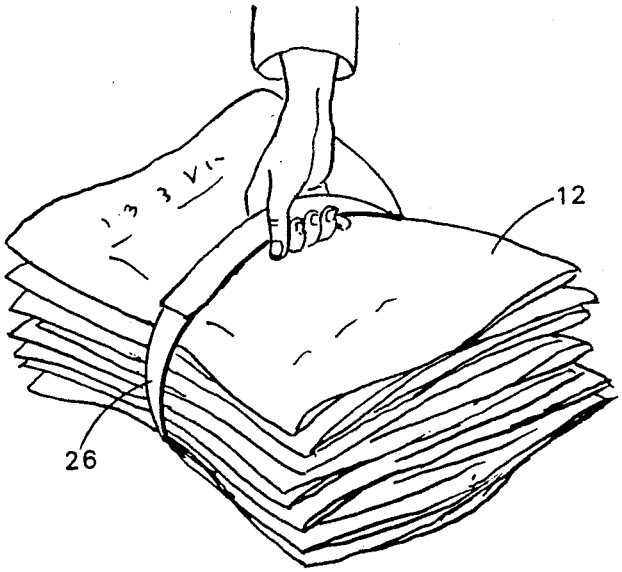
FIG. 5 is a perspective view of a hand carrying a stack of newspapers as bundled by the device of FIG. 1.

The stack of papers is now securely bundled and can be lifted off with one hand, as indicated in FIG. 5, and carried away. The paper strap and its adhesive are sufficiently strong and wide to hold the pile of papers securely enough that it can be carried and transported with one strap alone, i.e., the customary crossing straps are not necessary. The strap will be symmetricaly positioned around the stack of papers since holder 22 is centered in frame 10.

The bundled stack is 100% recyclable since the straps are made of paper and the adhesive and release liner are recyclable. Thus the user can take the stack to a paper mill where a worker can simply toss it directly into a pulping machine, straps included. The entire stack can be repulped for recycling into newsprint again. Since the stack is not contaminated by materials which are not recyclable, or which are not recyclable with the newspapers, no additional labor need be expended removing such contaminants. Thus the value of the reclaimed newspapers is greater than heretofore.

Thereafter the user begins the stacking process again. When the user accumulates another stack of papers, he or she will pull out the ends of the next strap in the stack. If the adhesive coatings on the straps are protected by their respective overlying straps, the user pulls the adhesive end of the second strap down off the third strap down and does not have to remove any release paper. (The exposed adhesive of the second strap will not be damaged since it is protected by the sides of channel 22.) If release paper is used, the user simply pulls the second strap out and removes its release paper. Then the user bundles the stack of papers together with the peeled release liner and carries them off as before.

When the user uses the last strap in the stack of straps, he or she replaces it with another stack of straps and begins the process anew.

FIG. 6—TUBULAR SHORT FRAME PORTION

Figure 6:
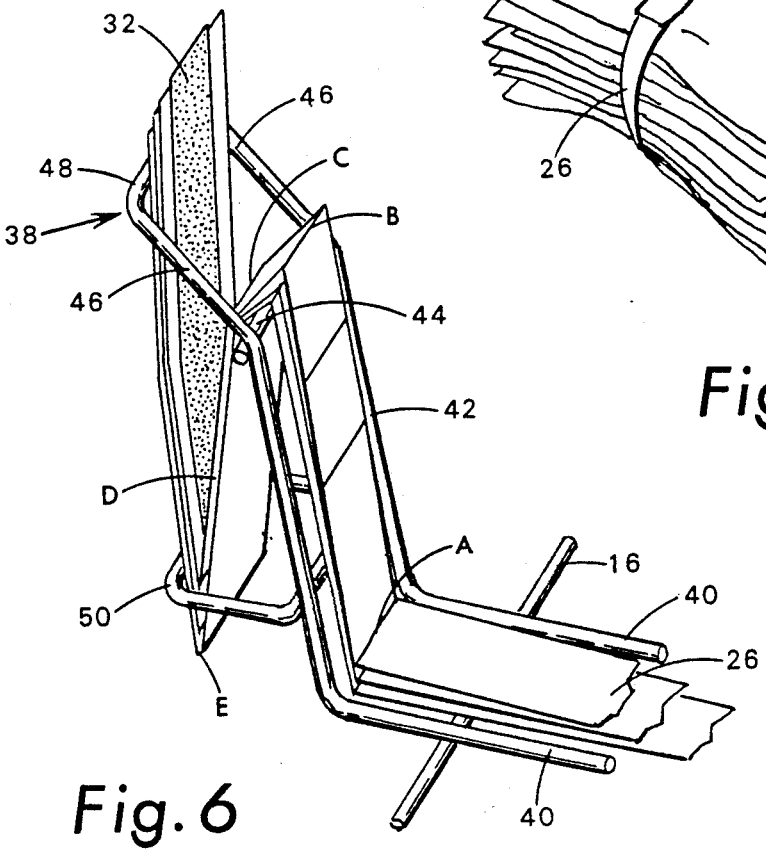
FIG. 6 is a partial perspective view of a newspaper bundler with a tubular metal cross member according to an alternative embodiment of the invention.

In lieu of a sheet metal holder 14 (FIGS. 1 and 2), a tubular holder 38 (FIG. 6) can be used. It is formed of tubular members or solid members such as wire which have a circular cross section. Its bed portion comprises paralleled tubular sections 40, spaced about 5 cm apart and welded to bottom sections 16 of frame 10. The tubular members then bend up at each side (only one side is shown) to form upright sections 42 which are joined by a crosspiece 44 about 9 cm up from sections 40. The members flare out to form upper sections 46 (about 4 cm long) and are joined by a bight portion 48. A bottom loop 50 about 3 cm by 5 cm is welded to upright sections 42 about 6 cm up. Tubular holder 38 functions similarly to holder 14. Its sections 44, 46, and 48 form the top of a pocket into which the end portions of a stack of straps 26 are inserted, as in FIG. 4. Bottom loop 50 guides the bottom portions of the straps, adjacent fold E. Note that folds C and D (not shown), in conjunction with fold B, enables the straps to more closely fold over crosspiece 44 during retrieval of the end sections of the strap just prior to bundling. Note how adhesive coating 32, formerly adherent to the back release surface of an overlying strap (not shown) is exposed, yet protected by the pocket.

SUMMARY, RAMIFICATIONS, AND SCOPE

The reader will thus see that, according to the invention, I have provided a newspaper bundler which is economical and simple, yet rugged, in construction, which is easy, quick, and simple to load and use, which uses economical recycled paper supplies, which does not require the manipulation, knotting, or tying of string or ties, the installation of spools of string, or any awkward, or complicated steps, which provides a resulting bundle which can be handled with one hand, which provides bundles with total recyclability, which increases the market value of recycled papers since contamination of the bundles is eliminated, and which, because it makes bundling of papers so quick, easy, and economical, encourages users to bundle and recycle, thereby ameliorating the problems of papers, proliferation of solid waste, deforestation, litter, and other problems relating to unbundled papers.

While the above description contains many specificities, these should not be construed as limitations on the scope of the invention, but as exemplifications of the presently-preferred embodiments thereof. Many other ramifications and variations are possible within the teachings of the invention. For example, the entire frame assembly can be made of one injection-molded part or of sheet metal, either with two U-shaped portions as shown or with a boxlike shape including a flat bottom, the partitions of the channels can be longer, shorter, joined to the inner edges of the channel, and/or the bottom or the top of the channel, the holder of the frame assembly can be made of tubing with a different shape than as shown, the straps can be made of a material other than paper, the frame assembly can have shapes other than rectangular, the frame can include orthogonal holders for two stacks of orthogonally positioned straps, the ends of the straps can be attached by other than adhesive, e.g., by slits and buttons, by stapling, etc., and the frame assembly can be used to stack and bundle sheets of material other than newspapers, such as waste office paper, currency, etc. Further the strap can be used by itself, without the frame, by simply laying it on a flat surface, stacking newspapers in the center, and then bundling as previously described.

Thus the scope of the invention should be determined by the appended claims and their legal equivalents, and not by the examples given.

I claim:

1. A bundler for bundling a stack of sheets of material, said bundler comprising:

a cradle for holding a stack of sheets of material, each sheet having at least one pair of opposing edges, said cradle having a bottom section for supporting said stack and a plurality of opposing sides extending up from said bottom section and facing each other for guiding and aligning said one pair of opposing edges of said sheets of said stack when they are piled individually into said cradle, at least one elongated bundling strap, said strap having a center section and two end sections, said center section sized to extend across said bottom of said cradle, each of said end sections being demarcated from said center section by a pair of respective first fold lines which are transverse to the direction of elongation of said strap, each end section comprising (a) a first portion extending up from one side of said center section to a second fold line which is transverse to the direction of elongation of said strap, (b) a second portion extending down from said second fold line to a third fold line which is transverse to the direction of elongation of said strap, and (c) a third portion extending up from said third fold line to a free end, each of said two opposing sides of said cradle comprising holder means for holding said bundling strap, said holder means comprises a pocket having a top opening facing generally away from said bottom section of said cradle, said second and third portions of each of said end sections of said bundling strap being inserted into a respective pocket.

2. The bundler of claim 1 wherein said bundling strap has securing means attached thereto and adjacent at least one of said free ends thereof for securing said free ends of said strap together when said strap is wrapped around said stack of said sheets of material.

3. The bundler of claim 2 wherein said securing means is an adhesive coating on said third portion of said strap.

4. The bundler of claim 3 wherein a plurality of said straps are provided in a stack in said cradle, one of said straps being a topmost strap in said stack, said third portion of each of said straps, except said topmost strap, having said adhesive coating thereon and being adhered to a bottom surface of a next higher strap in said stack, said bottom surface of said third portion of each of said straps comprising a release surface so that each of said straps can be peeled free of the next higher strap.

5. The bundler of claim 3 wherein said adhesive coating on said third portion of each of said straps is covered by a release membrane.

6. The bundler of claim 1 wherein said cradle comprises a pair of generally U-shaped members, each of which has a pair of elongated leg sections and an elongated connecting section transverse to said leg sections which connects corresponding ends of said leg sections and which is joined to said leg sections by a pair of respective bends, each of said connecting sections forming part of said bottom section of said cradle, said leg sections extending upward from said connecting section at said bottom section of said cradle to form a pair of additional sides of said cradle.

7. The bundler of claim 6 wherein said U-shaped members are each made of elongated members, each of which has a circular cross section and which are shaped to form an open framework.

8. The bundler of claim 7 wherein each of said leg sections of said U-shaped members comprises a pair of paralleled elongated members and an upper cross member joining said pair of paralleled members at a location spaced from said bottom section of said cradle and adjacent the ends of said leg sections distal from said bottom section of said cradle.

9. The bundler of claim 1 wherein said opposing sides of said cradle are formed of the legs of a generally U-shaped member, said U-shaped member having a connecting portion joining corresponding ends of said legs thereof, said connecting portion forming part of said bottom section of said cradle, each of said legs of said U-shaped member comprising a pair of paralleled elongated members having a pair of ends distal from said bottom section of said cradle, said pair of ends being connected by an upper connecting member, said pair of elongated members also being joined by a lower loop member at a location close to said bottom section of said cradle, such that said lower loop forms a bottom portion of said pocket of said holder.

10. The bundler of claim 1 wherein said opposing sides of said cradle are formed of sheet material shaped to form a pair of channels which mutually face each other and a central area of said cradle.

11. The bundler of claim 10 wherein each of said channels includes a partition spanning the sides of said channel and spaced from a center portion of said channel so as to form said pocket between said partition and said center portion and part of said sides of said channel.

12. The bundler of claim 11 wherein said partition is shorter than said channel and has lower and upper edges which are spaced from the bottom and top of said channel, respectively.

13. The bundler of claim 10, further including a second plurality of opposing sides extending up from said bottom section and facing each other for guiding and aligning a second pair of opposing edges of the sheets of said stack when they are piled individually into said cradle, said second plurality of opposing sides facing in a direction orthogonal to the direction faced by said first-named plurality of opposing sides of said cradle.

14. A bundler for enabling one to bundle easily and conveniently a stack of sheets of material and for holding a stack of bundling straps, each strap being of the type comprising a flat elongated strip of material having two opposing major surfaces having a predetermined width dimension transverse to its direction of elongation, said major surfaces being joined by two opposing edges, each strap also having a center section and two opposite end sections bounding said center section, each end section being joined to said center section by a bendable fold line, said bundler comprising:

a frame assembly, said frame assembly having a bottom portion and including a volume of space above said bottom portion, said frame assembly having a pair of side portions attached to extending up from said bottom portion so as to bound the sides of said volume of space above said bottom portion such that said sheets, when placed into said frame and over said bottom portion, will be aligned by said sides to form said stack, said side portions facing each other and comprising holder means for (a) holding said end sections, respectively, of said stack of elongated bundling straps at upright orientations to said center sections thereof when said center sections of said straps are placed across said bottom portion of said frame assembly, and for (b) preventing said end sections from falling away, in any direction, from said upright orientations, each of said holder means having a predetermined width approximately equal to the width of said straps.

15. The bundler of claim 14, further including said stack of elongated bundling straps, the center sections of said straps being positioned over said bottom portion of said frame assembly, said end sections of said straps being positioned in said respective guide channels.

16. The bundler of claim 14 wherein said frame assembly comprises a pair of generally U-shaped members, each U-shaped member having a transverse portion forming part of said bottom portion of said frame, and two legs portions joined to said transverse portion in a generally upright manner, said leg portions forming said side portions of said frame, said transverse portions of said U-shaped members being oriented in an orthogonal relationship and forming said bottom portion of said frame.

17. The bundler of claim 16 wherein one of said U-shaped members is made of sheet metal, each leg of said U-shaped member bent to form one of said channels.

18. The bundler of claim 17 wherein each of said channels includes a partition spanning the sides of said channel and spaced from a center section of said channel so as to form a pocket bounded by said partition, said center section, and parts of said side of said channel.

19. For use with a cradle for bundling a stack of sheets of material of a predetermined width, said cradle having a pair of upwardly opening pocket means on opposite sides of the width dimension of said cradle:

a bundling strap, said strap being elongated and having a center section and two end sections, said center section sized to extend across the width of said stack of sheets, said end sections each joined to said center section by a first fold line which is transverse to the direction of elongation of said strap, each of said end sections also comprising a first portion extending up from opposite sides of said bottom section and said first fold line to a second fold line which is transverse to the direction of elongation of said strap, a second portion extending down from said second fold line to a third fold line which is transverse to the direction of elongation of said strap, a third portion extending up from said third fold line to a free end, such that said second and third portions of said end sections can be folded together so as to be insertable into said pair of upwardly opening pocket means, and attachment means on said third portion at one end of said strap for joining it to said third portion at the other end of said strap in overlapping relation, said means and said strap being made of materials which are entirely repulpable.

20. The bundling strap of claim 19 wherein said attachment means comprises an adhesive coating and further including a plurality of additional straps arranged with said first-named strap to form a stack of said straps, one of said straps being a topmost strap in said stack, said third portion of each of said straps, except said topmost strap, having said adhesive coating thereon and being adhered to a bottom surface of a next higher strap in said stack, said bottom surface of said third portion of each of said straps comprising a release surface so that each of said straps can be peeled free of the next lower strap.

* * * * *